US012679582B2

(12) United States Patent
Liu

(10) Patent No.: US 12,679,582 B2
(45) Date of Patent: Jul. 14, 2026

(54) COFFEE CAPSULE MANUFACTURING TOOL AND ITS MANUFACTURING METHOD

(71) Applicant: Xiaofeng Liu, Foshan (CN)

(72) Inventor: Xiaofeng Liu, Foshan (CN)

( * ) Notice: Subject to any disclaimer, the term of this patent is extended or adjusted under 35 U.S.C. 154(b) by 391 days.

(21) Appl. No.: 18/401,053

(22) Filed: Dec. 29, 2023

(65) Prior Publication Data

US 2024/0336383 A1 Oct. 10, 2024

(30) Foreign Application Priority Data

Apr. 4, 2023 (CN) ..... 202310357063.1

(51) Int. Cl.
*B65B 29/02* (2006.01)

(52) U.S. Cl.
CPC ..... *B65B 29/022* (2017.08)

(58) Field of Classification Search
CPC ..... B30B 1/00; B65B 67/02
See application file for complete search history.

(56) References Cited

U.S. PATENT DOCUMENTS

2012/0269933 A1* 10/2012 Rapparini ..... B65D 85/812 206/0.5
2015/0128525 A1* 5/2015 Bartoli ..... B65B 47/06 53/410
2015/0246741 A1* 9/2015 Hansen ..... B65B 29/022 156/215
2017/0096243 A1* 4/2017 Manaresi ..... B29C 66/8322
2018/0215120 A1* 8/2018 Rapparini ..... B65B 43/50
2018/0319116 A1* 11/2018 Haug ..... B31B 50/594
2019/0375143 A1* 12/2019 Mathias ..... B29C 48/09
2022/0355959 A1* 11/2022 Liu ..... B30B 1/00
2023/0356869 A1* 11/2023 Scrivani ..... B65B 47/06
2023/0391484 A1* 12/2023 Oh ..... B65B 29/022
2024/0358194 A1* 10/2024 Etzinger ..... B65B 59/04
2025/0282529 A1* 9/2025 Zhao ..... B65B 7/28

FOREIGN PATENT DOCUMENTS

CN 113200165 A * 8/2021 ..... B65B 67/02

OTHER PUBLICATIONS

Machine translation of CN-113200165-A (Year: 2021).*

* cited by examiner

*Primary Examiner* — Himchan Song
(74) *Attorney, Agent, or Firm* — Westbridge IP LLC

(57) ABSTRACT

Disclosed are a coffee capsule manufacturing tool and its manufacturing method. The coffee capsule manufacturing tool comprises a capsule shell, a mode base, a sealing film, a pressing mold, a powder-filling member, and a powder-pressing member. The opening of the capsule shell is provided with an outer ring extending outer towards. The center of the powder-filling member is penetrated with a powder guiding channel, a bottom portion is provided with a powder-filling member powder-filling holder, the powder-filling holder is supported on the outer ring, an inside wall of the powder guiding channel extends towards the capsule shell and extends beyond the powder-filling holder, when the powder-filling holder is supported on the outer ring, it extends into the capsule shell, the powder-pressing member extends into the powder guiding channel and uniformly compresses the coffee powder inside the capsule shell.

9 Claims, 12 Drawing Sheets

COFFEE CAPSULE MANUFACTURING TOOL AND ITS MANUFACTURING METHOD

CROSS-REFERENCE TO RELATED APPLICATIONS

This application claims priority to Chinese Patent Application No. 202310357063.1, filed on Apr. 4, 2023, which is incorporated herein by reference in its entirety.

TECHNICAL FIELD

This present disclosure relates to the technological field of coffee capsule, in particular relates to a coffee capsule manufacturing tool and its manufacturing method.

BACKGROUND

Chinese Patent Publication CN113200165A discloses a rapid self-made tool for coffee capsules and its pressing method.

The tool comprises a mold base and a press mold, wherein the mold base is provided with a mold cavity for placing a capsule shell, and the opening of the capsule shell is covered with a sealing film. By pressing the press mold, the sealing film seals the opening of the capsule shell to make coffee capsules. The mold seat or press mold is provided with a guide member, which is used to guide the sealing film to align with the capsule shell coaxially before being pressed, and for vertically guiding the press mold up and down during pressing. The tool of the above structure can ensure that the sealing film can be laid in the center at the opening of the capsule shell before pressing through the guiding member. During the pressing process, the press mold moves downward vertically, allowing the press mold to evenly apply pressure on the outer ring of the capsule shell, improving the sealing effect between the sealing film and the capsule shell, and preventing the joint between the sealing film and the capsule shell from cracking. However, when filling coffee powder into the capsule shell, coffee powder is prone to spill on the outer ring of the capsule shell, causing the sealing film to not truly seal on the outer ring, resulting in the problem of coffee capsule powder dropping after manufacturing. Moreover, coffee powder cannot be evenly filled into the capsule shell, and there will always be local accumulation of coffee powder, causing the coffee capsule to be unable to fill enough coffee powder.

Therefore, it is necessary to make Furthermore improvements.

SUMMARY

The present disclosure aims to provide a coffee capsule manufacturing tool to overcome deficiencies in prior art.

A coffee capsule manufacturing tool designed for this purpose, comprising a mold base for positioning and placing a capsule shell, and a pressing mold for pressing a sealing film onto the capsule shell, wherein the coffee capsule manufacturing tool further comprises a powder-filling member, a powder-pressing member, an opening of the capsule shell extends outward with an outer ring; a center of the powder-filling member is penetrated with a powder guiding channel for guiding and filling coffee powder, and a bottom portion is provided with a powder-filling holder; the powder-filling holder is supported on the outer ring; an inside wall of the powder guiding channel extends towards the capsule shell and extends beyond the powder-filling holder, when the powder-filling holder is supported on the outer ring, it extends into the capsule shell, the powder-pressing member extends into the powder guiding channel and uniformly compresses the coffee powder inside the capsule shell.

A bottom surface of the powder-pressing member is a plane, and the bottom surface of the powder-pressing member aligns with or does not protrude beyond the bottom surface of the inside wall of the powder guiding channel when compressing the coffee powder.

An interior of the mold base is provided with a positioning cavity matching a shape of the capsule shell; an upper end surface of an outer wall of the mold base is provided with a guiding peripheral edge extending circumferentially, and an inner wall of the guiding peripheral edge is inclined towards the capsule shell; a side wall of the guiding peripheral edge is provided with a notch; an outside wall of the mold base is provided with an inclined edge corresponding to the notch, the inclined edge located at a bottom of the notch.

An upper end surface of an outer wall of the powder-filling member is provided with a powder-filling member holder extending circumferentially, a bottom surface of the powder-filling member holder is supported on a surface of the guiding peripheral edge; an upper end surface of an outer wall of the powder-pressing member is provided with a powder-pressing member holder extending circumferentially, and a bottom surface of the powder-pressing member holder is supported on a surface of the powder-filling member holder.

An outer periphery of the outer ring is provided with an arc-shaped convex section; an outer periphery of the powder-filling member holder is provided with a powder-filling member positioning recessed ring; an opening of the mold base extends outward with a positioning platform; an outer periphery of the positioning platform is provided with a positioning recessed ring; the capsule shell is supported on the positioning platform by the outer ring; when the powder-filling member is placed on the mold base, up and down positions of the arc-shaped convex section are respectively positioned and matched with the powder-filling member positioning recessed ring and the positioning recessed ring of the mold base in a concave convex manner.

A lower portion of the powder-filling member is provided with a powder-filling member guiding portion used to guide and place into the guiding peripheral edge, and the powder-filling member guiding portion is located in an outer periphery of the powder-filling member positioning recessed ring.

The powder guiding channel is circular, and an upper portion of an inside wall of the powder guiding channel is provided with an inclined section facing the capsule shell; the inclined section is composed of an inclined angle or multiple inclined angles connected end-to-end, a lower portion of the inclined section is provided with a vertical section, and a bottom end of the vertical section extends towards the capsule shell.

The inclined section of the powder guiding channel is provided with several ventilation slots at circumferential intervals; an opening of an upper end of the ventilation slot traverses the upper end surface of the powder-filling member; a lower end of the ventilation slot extends to a middle portion or a lower portion of the inclined section of the powder guiding channel.

An upper portion of an outside wall of the powder-pressing member is spaced apart and coordinated with the inclined section of the powder guiding channel; a lower portion of an outside wall of the powder-pressing member is sequentially provided with a powder-pressing member inclined portion and a powder-pressing member vertical portion, the powder-pressing member inclined portion is inclined towards the capsule shell; the powder-pressing member inclined portion is spaced apart and coordinated with a local position of the inclined section of the powder guiding channel; the powder-pressing member inclined portion abuts against a remaining position of the inclined segment of the powder guiding channel; and the powder-pressing member vertical portion abuts against the vertical section of the powder guiding channel.

The outside wall of the pressing mold is provided with a pressing mold inclined portion that matches the guiding peripheral edge; a bottom surface of the pressing mold is provided with a circular recess in an opposite direction of the capsule shell; an outer periphery of the circular recess is provided with a pressing plane; an outer periphery of the pressing plane is provided with a pressing mold positioning recessed ring.

The powder-filling member and the powder-pressing member are removed from the mold base after the coffee powder is filled flat; the mold base enters the guiding peripheral edge through the pressing mold inclined portion after the powder-filling member and the powder-pressing member are removed, and upon entering, the pressing plane presses the outer periphery of the sealing film onto the outer ring, the up and down positions of the arc-shaped convex section are respectively positioned and matched with the pressing mold positioning recessed ring and the positioning recessed ring of the mold base in a concave convex manner.

A lower portion of the pressing mold inclined portion is provided with a pressing mold guiding portion used to guide and enter into the guiding peripheral edge; the pressing mold guiding portion is located on an outer periphery of the pressing mold positioning recessed ring; an upper end surface of an outside wall of the pressing mold is provided with a pressure mold holding portion extending circumferentially.

The present disclosure improves the structure by extending the inner wall of the powder guiding channel, so that when the powder-filling member is placed on the mold seat, the powder guiding channel can extend into the capsule shell and block the outer ring, ensuring that coffee powder does not spill on the outer ring when filling the capsule shell, allowing the sealing film to fully contact the outer ring, and ensuring that the sealing film does not detach when pressed against the outer ring. Moreover, the coffee powder is placed in the mold seat after the capsule shell is positioned, effectively avoiding the problem of coffee powder falling off caused by filling the capsule shell first and then positioning the capsule shell, thereby improving the manufacturing convenience of coffee capsules. Moreover, by using the downward pressure of the powder-pressing member, the coffee powder can be evenly pressed inside the capsule shell to avoid the problem of local accumulation of coffee powder during filling. This allows the capsule shell to fill a sufficient amount of coffee powder, resulting in higher coffee concentration, better taste and flavor, and stronger practicality.

DETAILED DESCRIPTION OF THE EMBODIMENTS

In order to make the above objectives, features, and advantages of the present disclosure more obvious and understandable, a detailed explanation of the specific embodiments of the present disclosure will be provided below in conjunction with the accompanying drawings. Many specific details are elaborated in the following description to facilitate a thorough understanding of the present disclosure. However, the present disclosure can be implemented in many ways different from the other described herein, and those skilled in the art can make similar improvements without violating the content of the present disclosure. Therefore, the present disclosure is not limited by the specific embodiments disclosed below.

The present disclosure will be further described below in conjunction with the accompanying drawings and embodiments.

Figure 1:
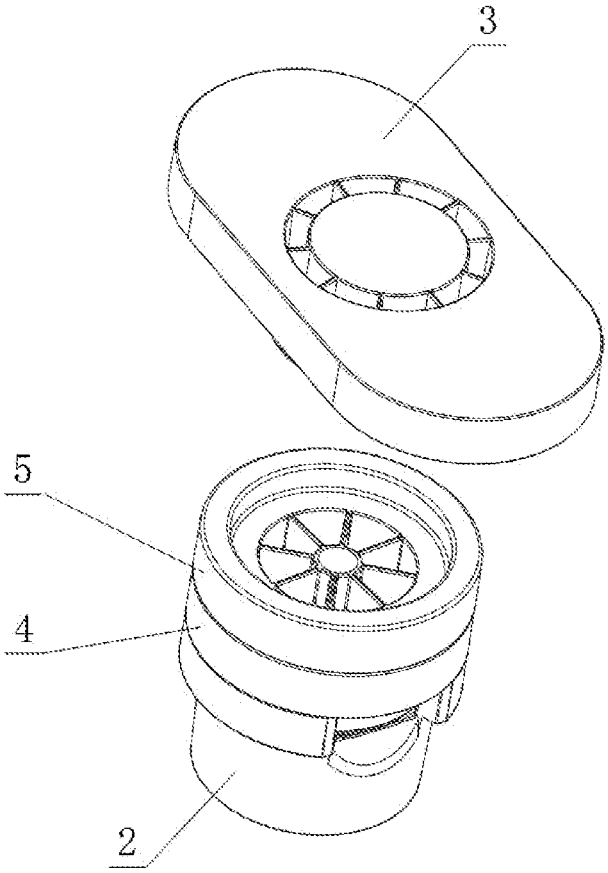
FIG. 1 is a schematic diagram of the assembly structure of an embodiment of the present disclosure.
Figure 2:
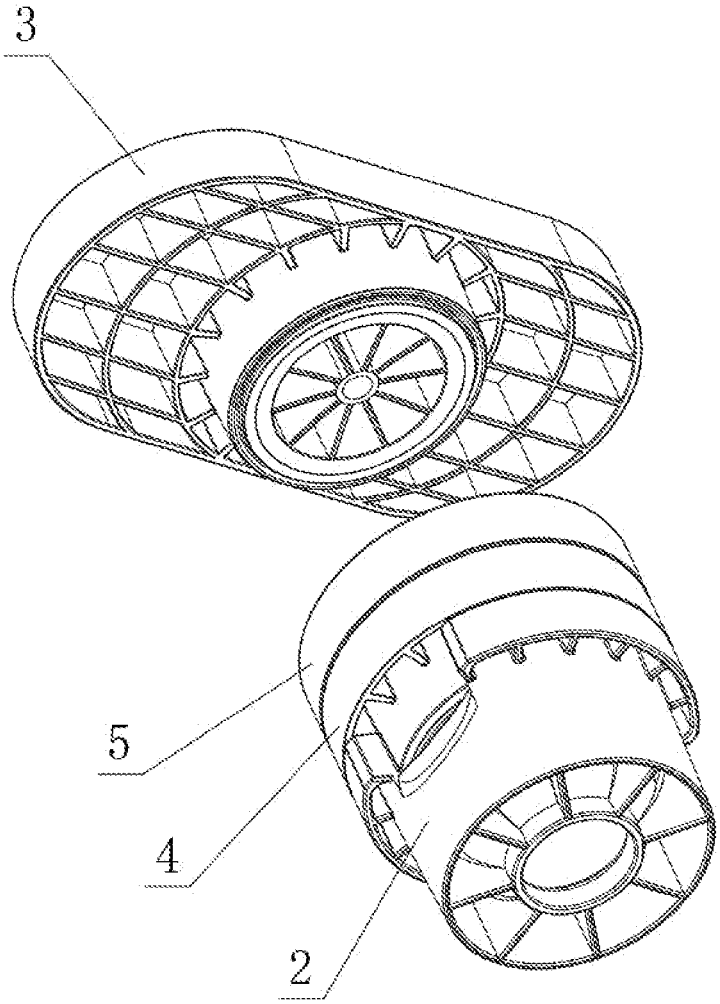
FIG. 2 is a schematic diagram of the assembly structure from another perspective of an embodiment of the present disclosure.
Figure 3:
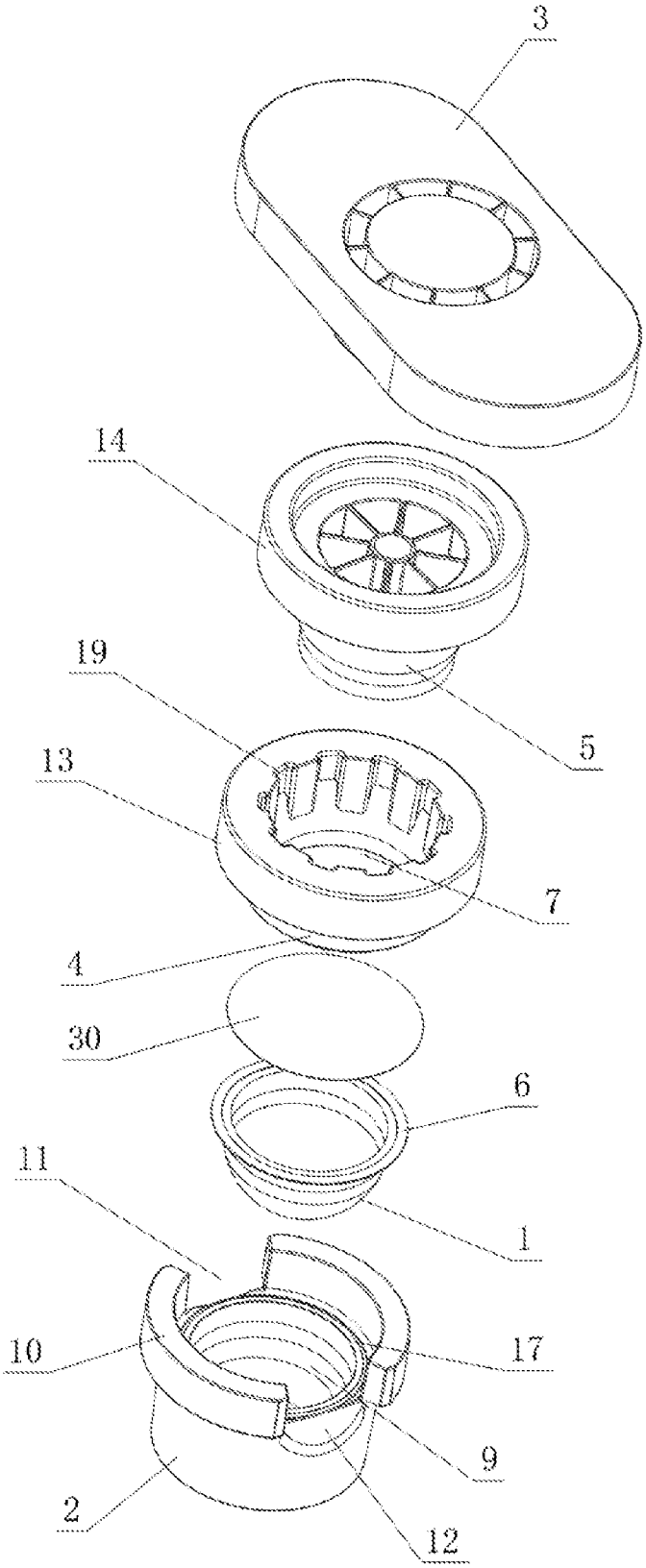
FIG. 3 a schematic diagram of the exploded structure of an embodiment of the present disclosure.
Figure 4:
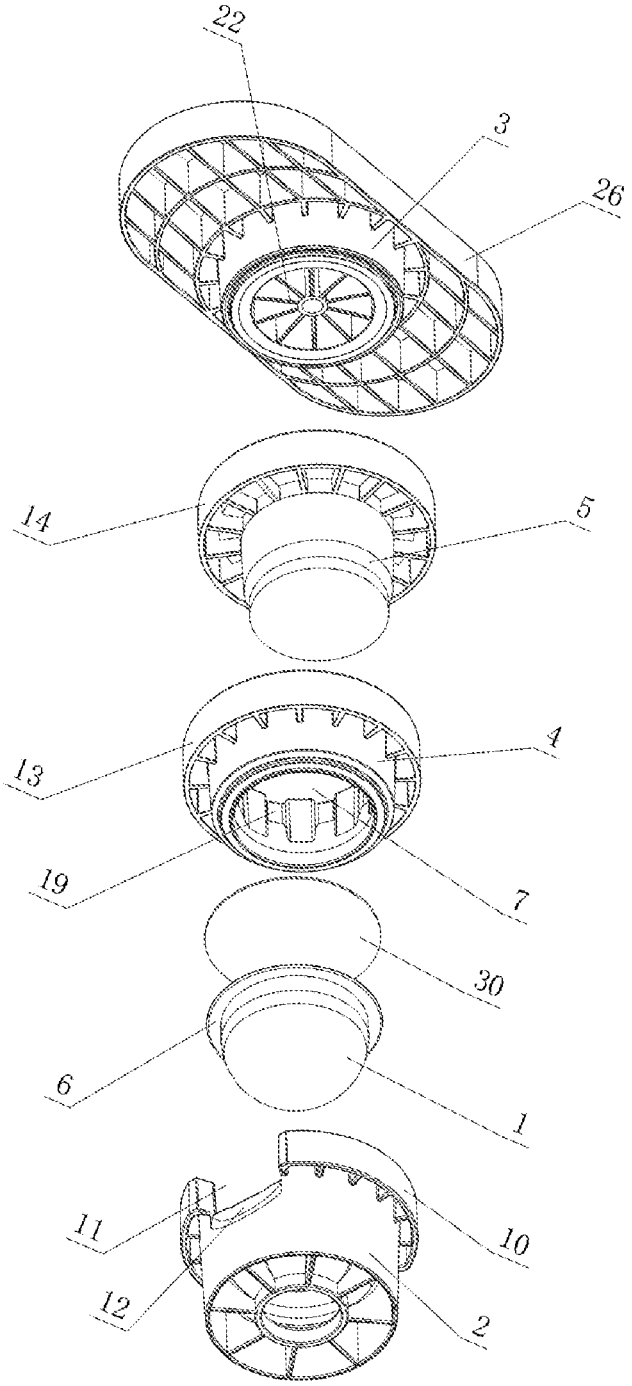
FIG. 4 is a schematic diagram of an exploded structure from another perspective of an embodiment of the present disclosure.
Figure 5:
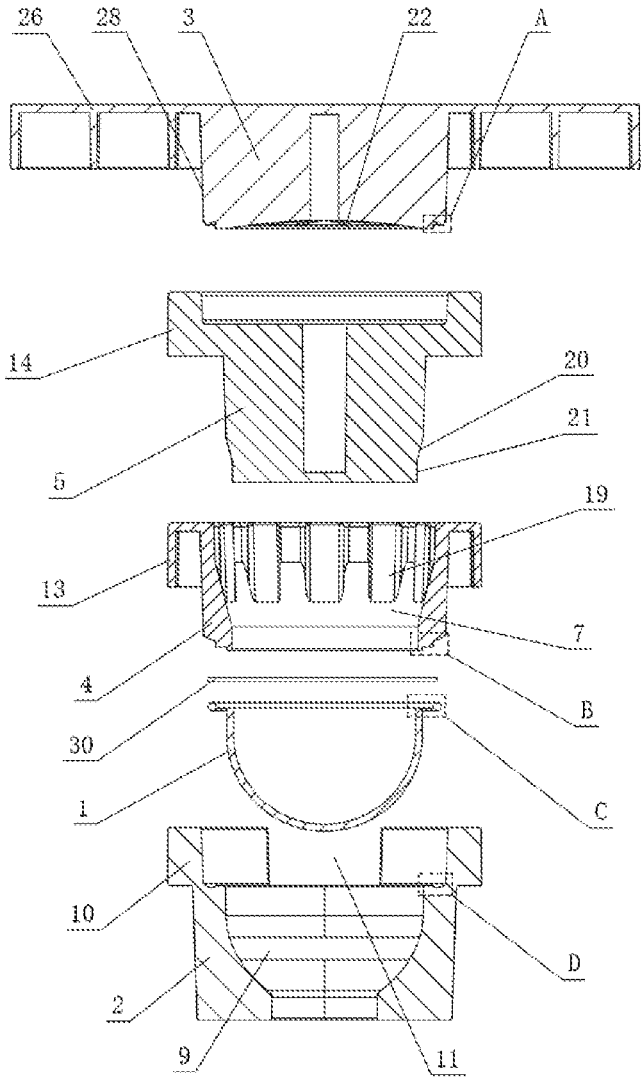
FIG. 5 is a schematic diagram of the assembly cross-sectional structure of an embodiment of the present disclosure.
Figure 6:
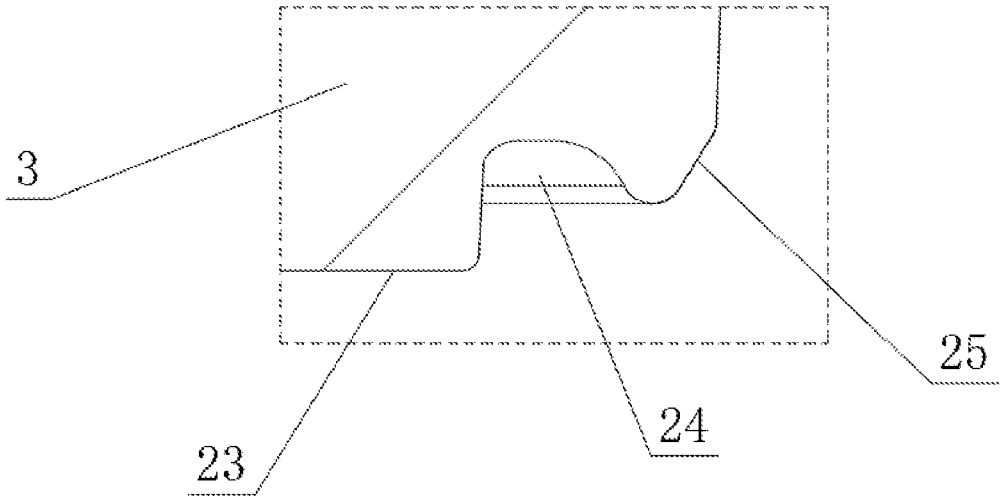
FIG. 6 is a schematic diagram of the enlarged structure of the area A in FIG. 5.
Figure 7:
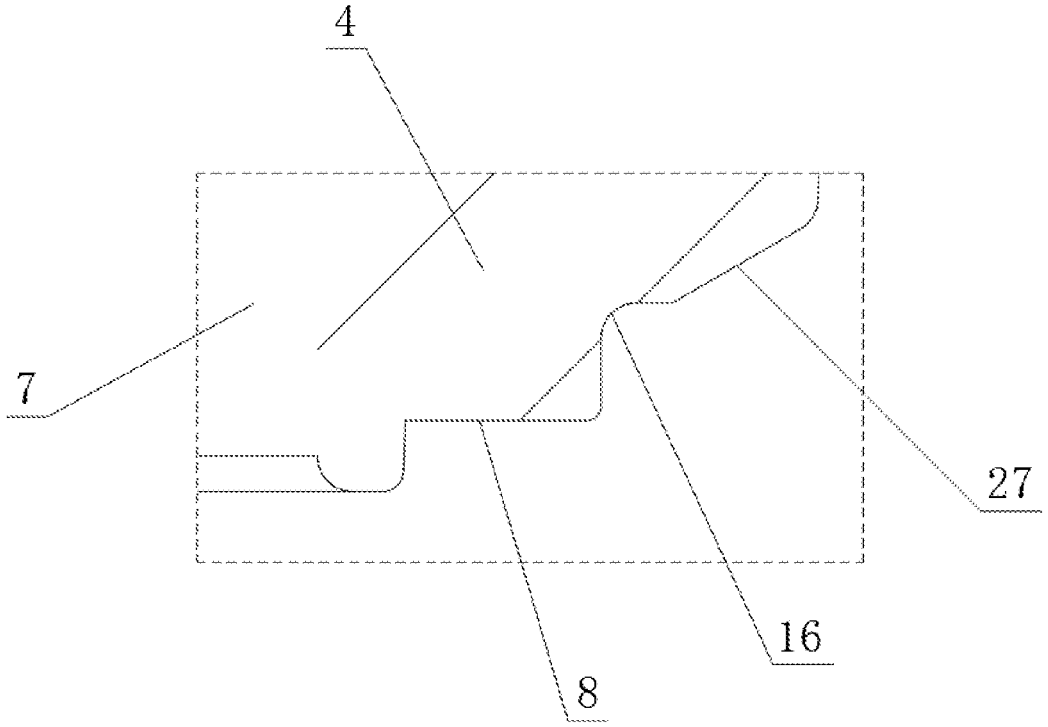
FIG. 7 is a schematic diagram of the enlarged structure of the area B in FIG. 5.
Figure 8:
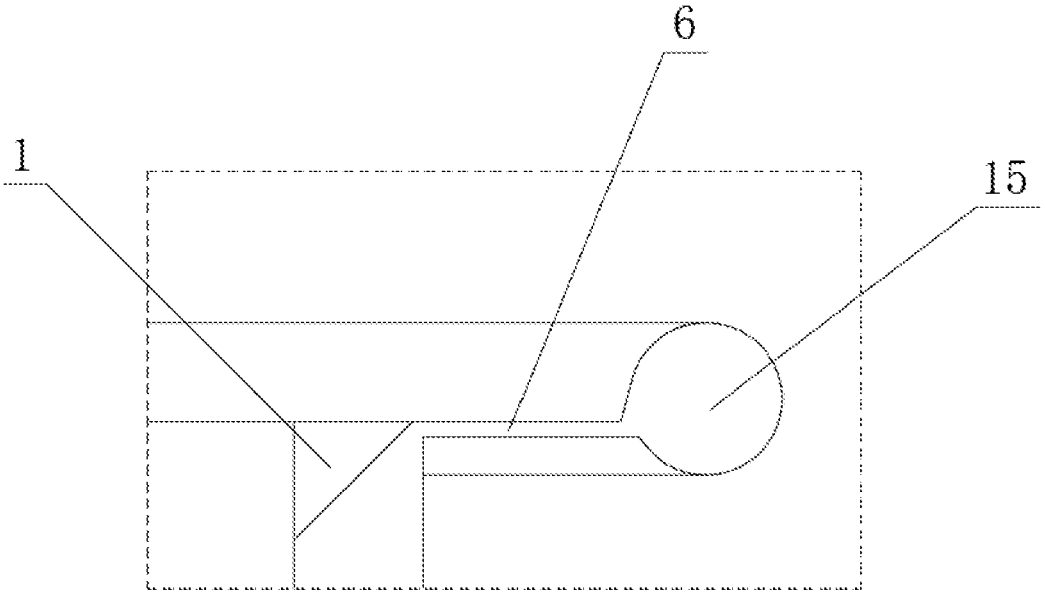
FIG. 8 is a schematic diagram of the enlarged structure of the area C in FIG. 5.
Figure 9:
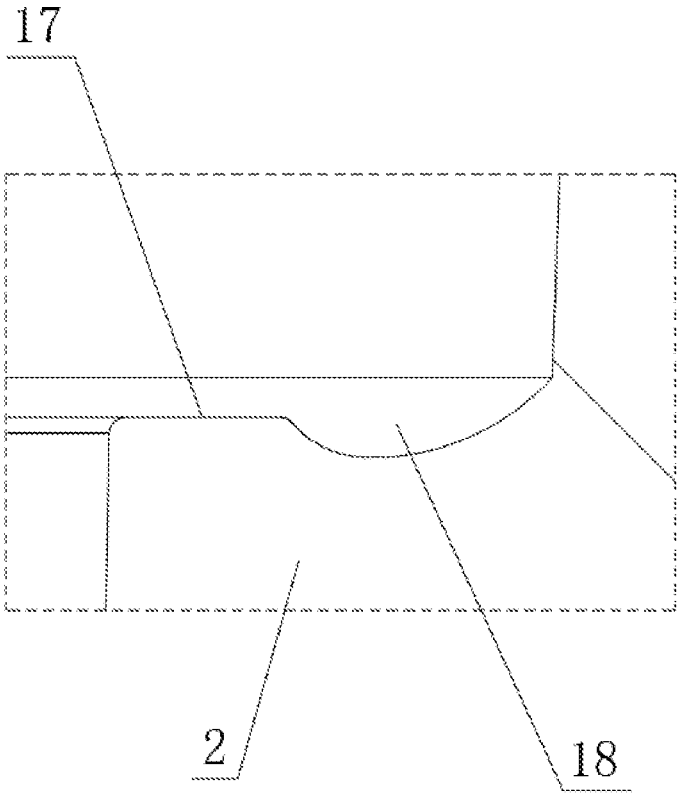
FIG. 9 is a schematic diagram of the enlarged structure of the area D in FIG. 5.
Figure 10:
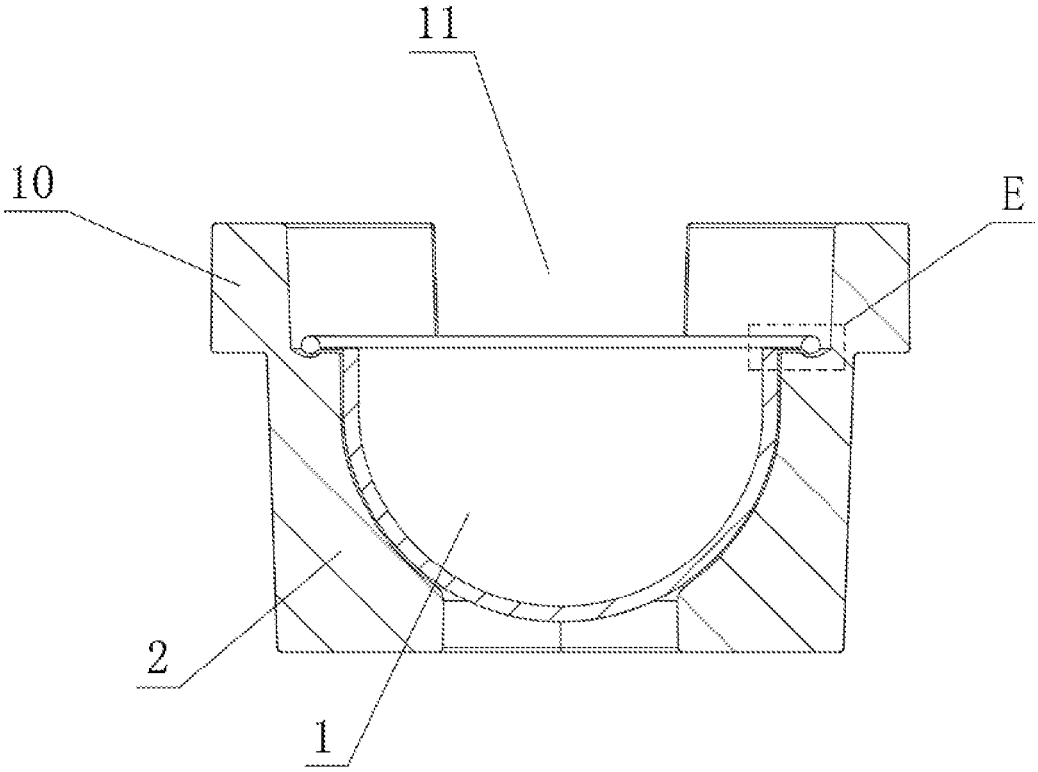
FIG. 10 is a schematic diagram of the assembly structure of a capsule shell and a mold base.
Figure 11:
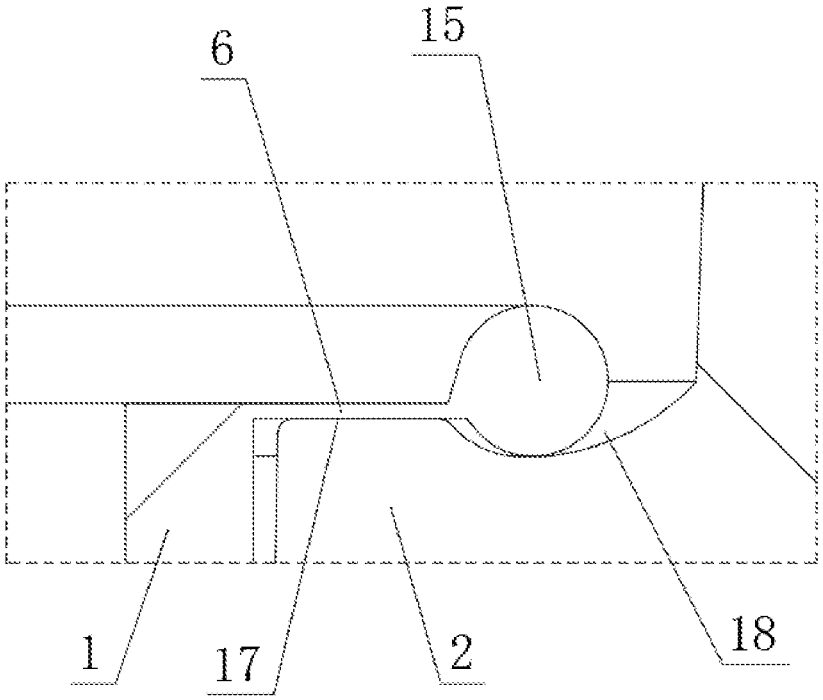
FIG. 11 is a schematic diagram of the enlarged structure of the area E in FIG. 10.
Figure 12:
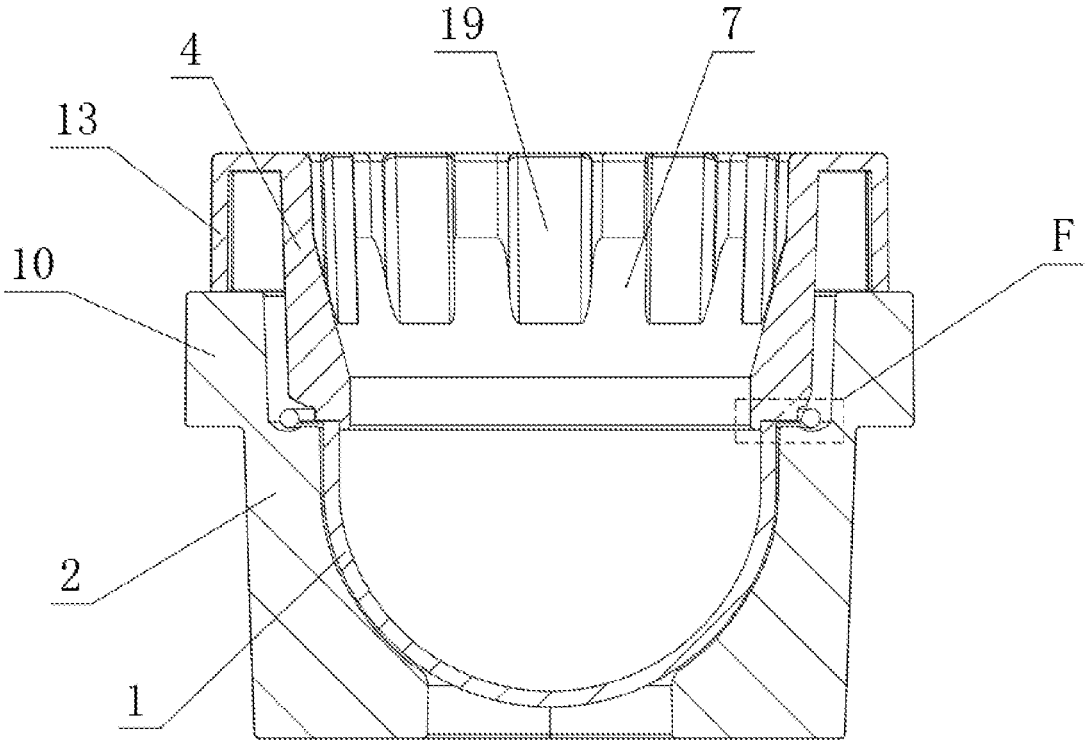
FIG. 12 is a schematic diagram of the assembly structure of a capsule shell, a mold base, and a powder-filling member.
Figure 13:
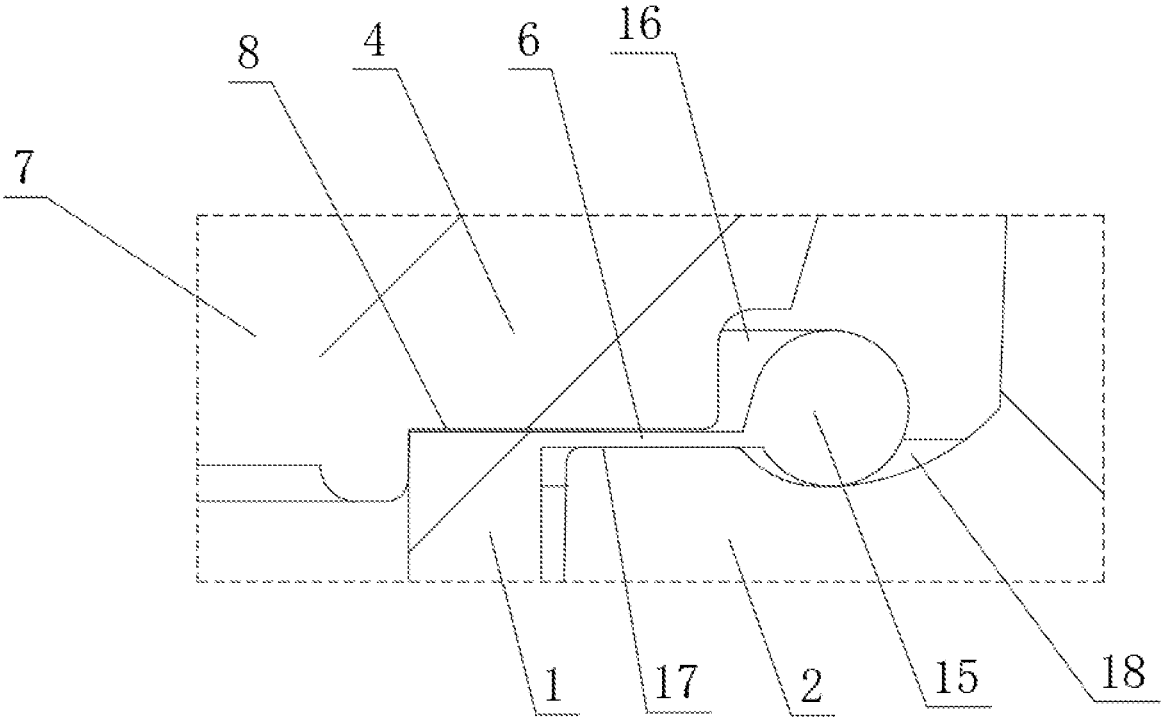
FIG. 13 is a schematic diagram of the enlarged structure of the area F in FIG. 12
Figure 14:
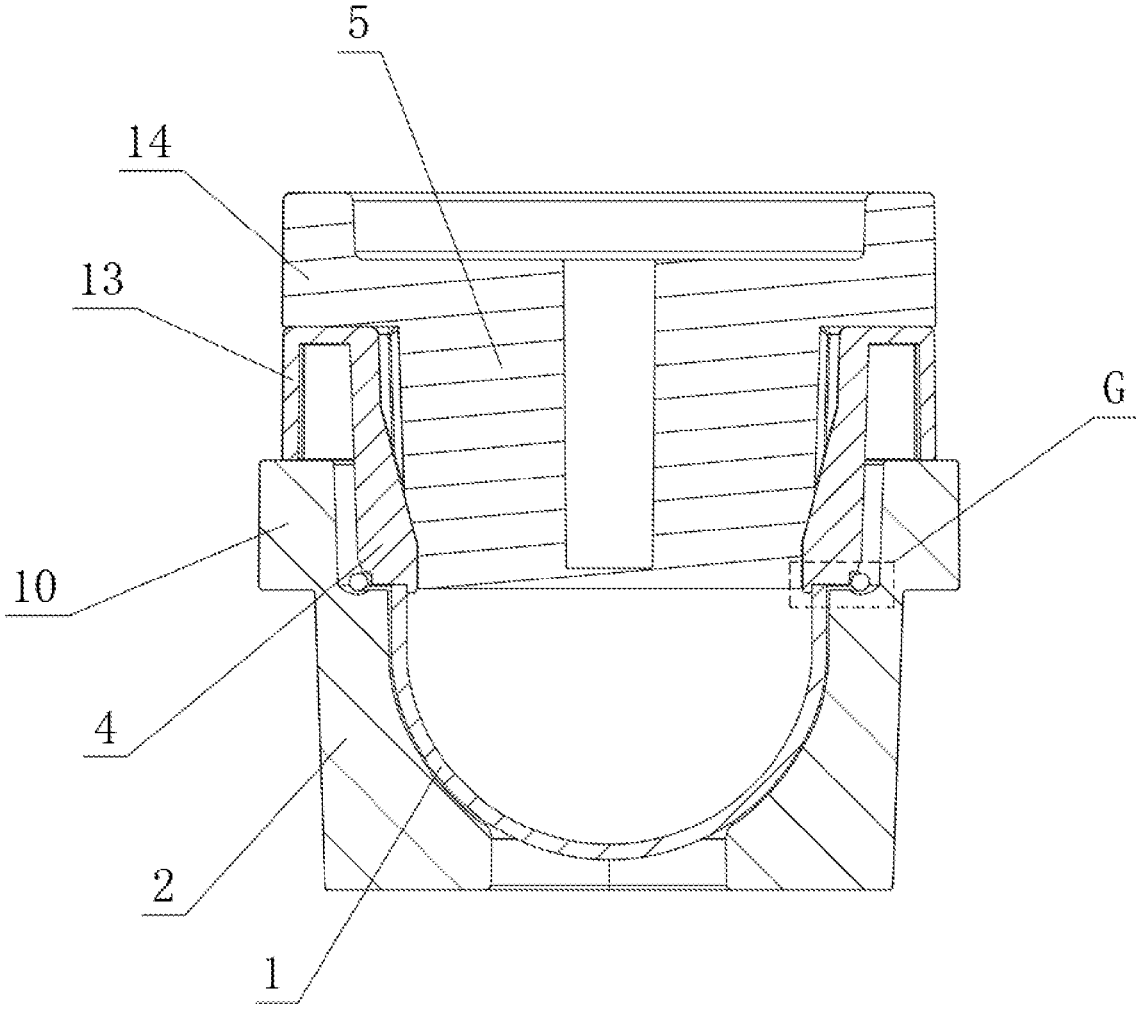
FIG. 14 is a schematic diagram of the assembly structure of a capsule shell, a mold base, a powder-filling member, and a powder-pressing member.
Figure 15:
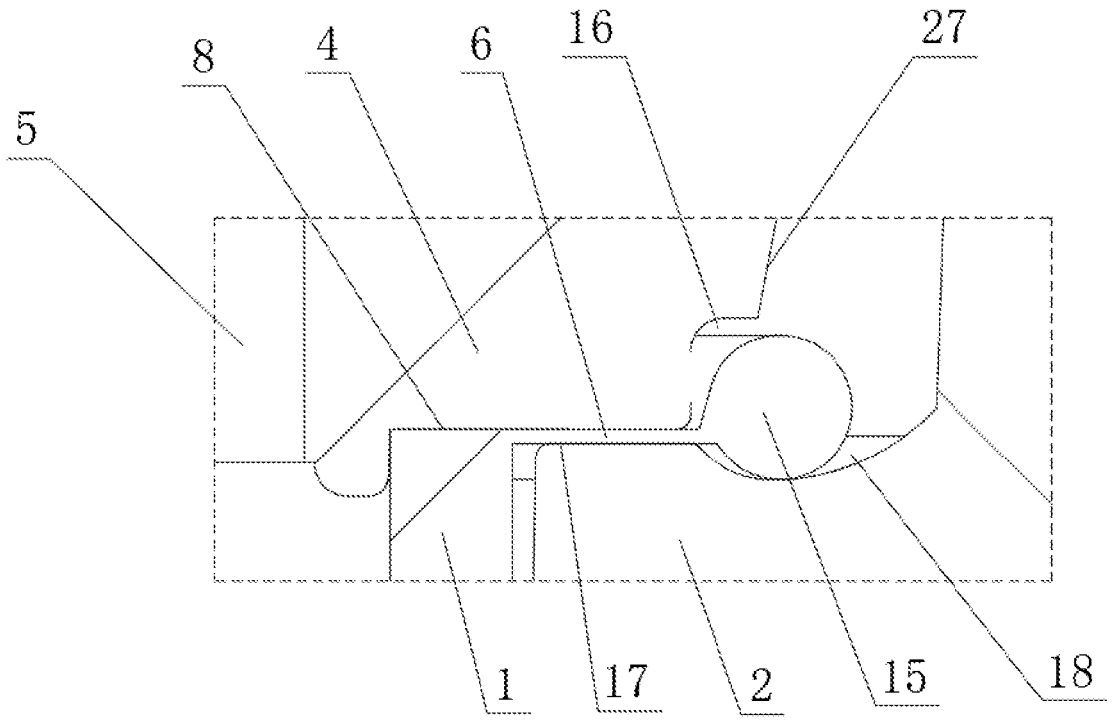
FIG. 15 is a schematic diagram of the enlarged structure of the area G in FIG. 14.
Figure 16:
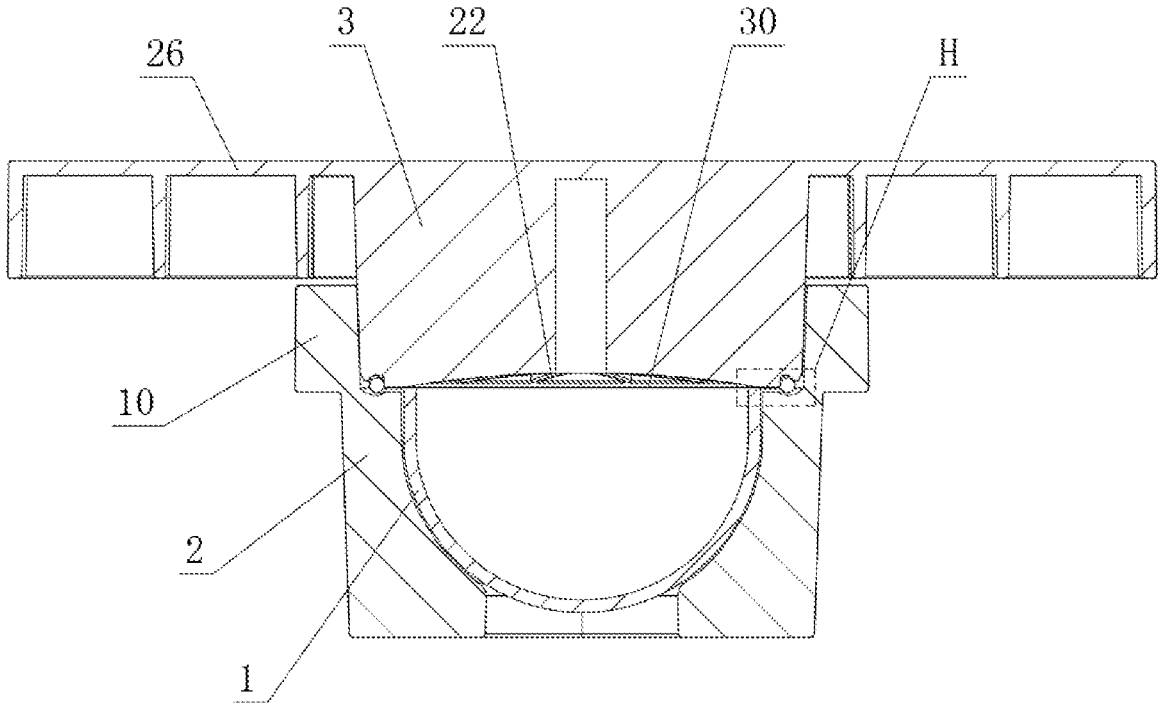
FIG. 16 is a schematic diagram of the assembly structure of a capsule shell, a mold base, and a pressing mold.
Figure 17:
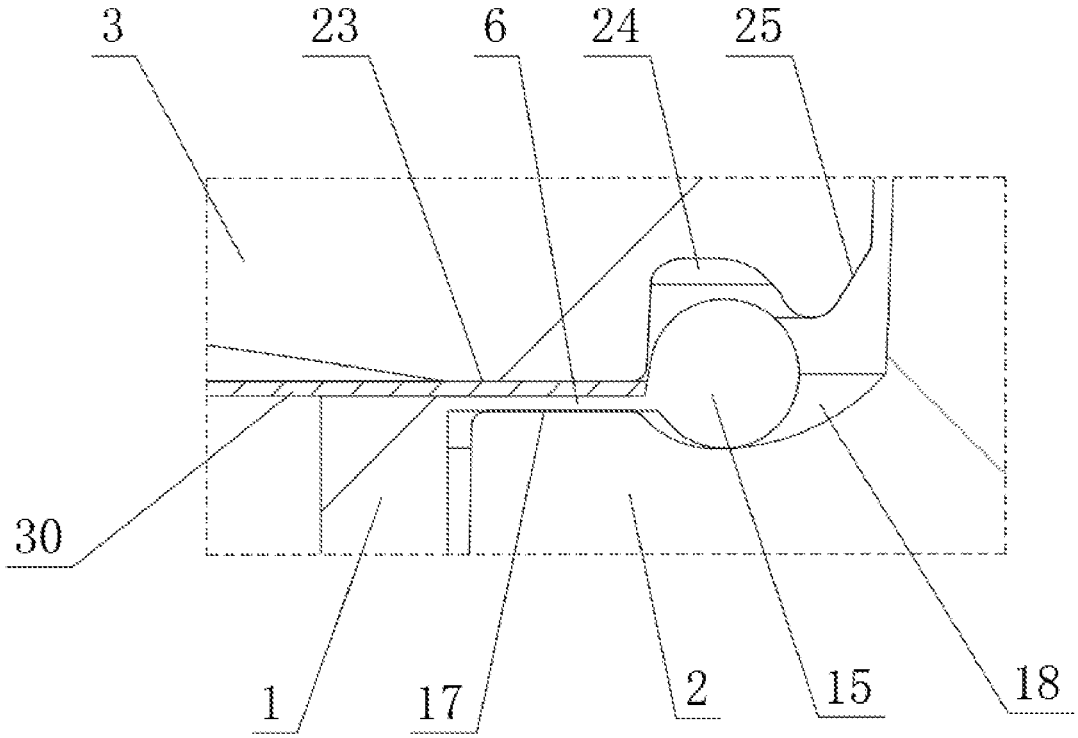
FIG. 17 is a schematic diagram of the enlarged structure of the area H in FIG. 16.

Referring to FIGS. 1 to 17, the coffee capsule manufacturing tool comprises a mold base 2 for positioning and placing a capsule shell 1, and a pressing mold 3 for pressing a sealing film 30 onto the capsule shell 1, wherein the coffee capsule manufacturing tool further comprises a powder-filling member 4, a powder-pressing member 5, an opening of the capsule shell 1 extends outward with an outer ring 6; a center of the powder-filling member 4 is penetrated with a powder guiding channel 7 for guiding and filling coffee powder, and a bottom portion is provided with a powder-filling holder 8; the powder-filling holder 8 is supported on the outer ring 6; an inside wall of the powder guiding channel 7 extends towards the capsule shell 1 and extends beyond the powder-filling holder 8, when the powder-filling holder 8 is supported on the outer ring 6, it extends into the capsule shell 1, the powder-pressing member 5 extends into the powder guiding channel 7 and uniformly compresses the coffee powder inside the capsule shell 1.

In this embodiment, by extending the inner wall of the powder guiding channel 7, so that when the powder-filling member 4 is placed on the mold seat 2, the powder guiding channel 7 can extend into the capsule shell 1 and block the outer ring 6, ensuring that coffee powder does not spill on the outer ring 6 when filling the capsule shell 1, allowing the sealing film 30 to fully contact the outer ring 6, and ensuring that the sealing film 30 does not detach when pressed against the outer ring 6. Moreover, the coffee powder is placed in the mold seat 2 after the capsule shell 1 is positioned, effectively avoiding the problem of coffee powder falling off caused by filling the capsule shell 1 first and then positioning the capsule shell 1, thereby improving the manufacturing convenience of coffee capsules. Moreover, by using the downward pressure of the powder-pressing member 5, the coffee powder can be evenly pressed inside the capsule shell 1 to avoid the problem of local accumulation of coffee powder during filling. This allows the capsule shell 1 to fill a sufficient amount of coffee powder, resulting in higher coffee concentration, better taste and flavor, and stronger practicality.

A bottom surface of the powder-pressing member 5 is a plane, and the bottom surface of the powder-pressing member 5 aligns with or does not protrude beyond the bottom surface of the inside wall of the powder guiding channel 7 when compressing the coffee powder.

In this embodiment, the bottom surface of the powder-pressing member 5 is a plane, and the bottom surface of the powder-pressing member 5 does not protrude beyond the bottom surface of the inside wall of the powder guiding channel 7 when compressing the coffee powder, so that the capsule shell 1 can fill more coffee powder.

An interior of the mold base 2 is provided with a positioning cavity 9 matching a shape of the capsule shell 1; an upper end surface of an outer wall of the mold base 2 is provided with a guiding peripheral edge 10 extending circumferentially, and an inner wall of the guiding peripheral edge 10 is inclined towards the capsule shell 1; a side wall of the guiding peripheral edge 10 is provided with a notch 11; an outside wall of the mold base 2 is provided with an inclined edge 12 corresponding to the notch 11, the inclined edge 12 located at a bottom of the notch 11.

In this embodiment, the inclined guiding peripheral edge 10 can guide the capsule shell 1, sealing film 30, and pressing mold 3, so that the capsule shell 1, sealing film 30, and pressing mold 3 can be longitudinally placed on the mold seat 2. At the same time, the setting of notch 11 and inclined edge 12 facilitates the user to take and place the capsule shell 1 and sealing film 30 on the mold seat 2 and align them axially.

An upper end surface of an outer wall of the powder-filling member 4 is provided with a powder-filling member holder 13 extending circumferentially, a bottom surface of the powder-filling member holder 13 is supported on a surface of the guiding peripheral edge 10; an upper end surface of an outer wall of the powder-pressing member 5 is provided with a powder-pressing member holder 14 extending circumferentially, and a bottom surface of the powder-pressing member holder 14 is supported on a surface of the powder-filling member holder 13.

The setting of the powder-filling member holder 13 and the powder-pressing member holder 14 not only facilitates the user to take and place the powder-filling member 4 and the powder-pressing member 5 on the mold seat 2, but also achieves longitudinal positioning between the mold seat 2, the powder-filling member 4, and the powder-pressing member 5.

An outer periphery of the outer ring 6 is provided with an arc-shaped convex section 15; an outer periphery of the powder-filling member holder 8 is provided with a powder-filling member positioning recessed ring 16; an opening of the mold base 2 extends outward with a positioning platform 17; an outer periphery of the positioning platform 17 is provided with a positioning recessed ring 18; the capsule shell 1 is supported on the positioning platform 17 by the outer ring 6; when the powder-filling member 4 is placed on the mold base 2, up and down positions of the arc-shaped convex section 15 are respectively positioned and matched with the powder-filling member positioning recessed ring 16 and the positioning recessed ring 18 of the mold base in a concave convex manner.

Through the above settings, it is possible to ensure the coaxial alignment between capsule shell 1, mold seat 2, powder-filling member 4, and powder-pressing member 5. At the same time, it is also possible to ensure that capsule shell 1 can be positioned up and down between mold seat 2 and powder-filling member 4, ensuring that there is no displacement problem with capsule shell 1 during coffee powder filling.

a lower portion of the powder-filling member 4 is provided with a powder-filling member guiding portion 27 used to guide and place into the guiding peripheral edge 10, and the powder-filling member guiding portion 27 is located in an outer periphery of the powder-filling member positioning recessed ring 16. When placing the powder-filling member 4, it is placed on the mold seat 2 through the powder-filling member guiding portion 27 and the guiding peripheral edge 10, in order to facilitate the placement of the powder-filling member 4 by the user.

the powder guiding channel 7 is circular, and an upper portion of an inside wall of the powder guiding channel 7 is provided with an inclined section facing the capsule shell 1; the inclined section is composed of an inclined angle or multiple inclined angles connected end-to-end, a lower portion of the inclined section is provided with a vertical section, and a bottom end of the vertical section extends towards the capsule shell 1.

In this embodiment, the inclined section of the powder guiding channel 7 is composed of an inclined angle, and at the same time, the lower portion of the inclined section is a vertical section. The bottom portion of the vertical section extends towards the capsule shell 1 and exceeds the powder-filling holder 8. When the powder-filling holder 8 is supported on the outer ring 6, it extends into the capsule shell 1 to make it easy for coffee powder to enter into the capsule shell 1.

The inclined section of the powder guiding channel 7 is provided with several ventilation slots 19 at circumferential intervals; an opening of an upper end of the ventilation slot 19 traverses the upper end surface of the powder-filling member 4; a lower end of the ventilation slot 19 extends to a middle portion or a lower portion of the inclined section of the powder guiding channel 7. The setting of several ventilation slots 19 can discharge the air inside the capsule shell 1 and the powder guiding channel 7 when the powder-pressing member 5 is pressed down. This not only helps to discharge the air inside the capsule shell and the powder guiding channel 7, but also avoids the problem of coffee powder flying due to air flow.

An upper portion of an outside wall of the powder-pressing member 5 is spaced apart and coordinated with the inclined section of the powder guiding channel 7; a lower portion of an outside wall of the powder-pressing member 5 is sequentially provided with a powder-pressing member inclined portion 20 and a powder-pressing member vertical portion 21, the powder-pressing member inclined portion 20 is inclined towards the capsule shell 1; the powder-pressing member inclined portion 20 is spaced apart and coordinated with a local position of the inclined section of the powder guiding channel 7; the powder-pressing member inclined portion 20 abuts against a remaining position of the inclined segment of the powder guiding channel 7; and the powder-pressing member vertical portion 21 abuts against the vertical section of the powder guiding channel 7.

Through the above settings, it is easy for users to align axially between capsule shell 1, powder-filling member 4, and powder-pressing member 5. At the same time, it is also possible to reasonably exhaust the air inside capsule shell 1 and powder guiding channel 7, and it is also convenient for users to pick up and place the powder pressing member 5.

the outside wall of the pressing mold 3 is provided with a pressing mold inclined portion 28 that matches the guiding peripheral edge 10; a bottom surface of the pressing mold 3 is provided with a circular recess 22 in an opposite direction of the capsule shell 1; an outer periphery of the circular recess 22 is provided with a pressing plane 23; an outer periphery of the pressing plane 23 is provided with a pressing mold positioning recessed ring 24.

The powder-filling member 4 and the powder-pressing member 5 are removed from the mold base 2 after the coffee powder is filled flat; the mold base 3 enters the guiding peripheral edge 10 through the pressing mold inclined portion 28 after the powder-filling member 4 and the powder-pressing member 5 are removed, and upon entering, the pressing plane 23 presses the outer periphery of the sealing film 30 onto the outer ring 6, the up and down positions of the arc-shaped convex section 15 are respectively positioned and matched with the pressing mold positioning recessed ring 24 and the positioning recessed ring 18 of the mold base in a concave convex manner.

Through the above settings, it is possible to ensure the coaxial alignment between capsule shell 1, mold seat 2, and pressing mold 3, and also ensure that capsule shell 1 can be positioned up and down between mold seat 2 and pressing mold 3, ensuring that the sealing film 30 can be aligned and pressed against the outer ring 6.

A lower portion of the pressing mold inclined portion 28 is provided with a pressing mold guiding portion 25 used to guide and enter into the guiding peripheral edge 10; the pressing mold guiding portion 25 is located on an outer periphery of the pressing mold positioning recessed ring 24. The pressing mold 3 is placed on the mold seat 2 through the pressing mold guiding portion 25 and the guiding peripheral edge 10 during placement, in order to facilitate the placement of the pressing mold 3 by the user. An upper end surface of an outside wall of the pressing mold 3 is provided with a pressure mold holding portion 26 extending circumferentially.

The manufacturing method of the above-mentioned coffee capsules comprises the following steps.

Step 1: Using the guiding effect of the guiding peripheral edge 10, place the empty capsule shell 1 into the positioning cavity 9.

Step 2: Using the guiding effect of the guiding peripheral edge 10, place the powder-filling member 4 on the mold seat 2, while the outer ring 6 is supported on the positioning platform 17 and the powder-filling holder 8 is supported on the outer ring 6. The up and down positions of the arc-shaped convex section 15 are respectively positioned on the positioning recessed ring 16 of the powder-filling member and the positioning recessed ring 18 of the mold seat. The bottom surface of the inner wall of the powder guiding channel 7 extends into the capsule shell 1. So as to ensure that the capsule shell 1, mold seat 2, and powder-filling member 4 are coaxial positioning and matching with each other.

Step 3: Using the guiding effect of the powder guiding channel 7, pour the coffee powder into the capsule shell 1.

Step 4: Using the cooperation between the outer wall of powder-pressing member 5 and the inner wall of powder guiding channel 7, vertically place the powder-pressing member 5 into the powder guiding channel 7, thereby ensuring the coaxial fit between the powder-pressing member 5 and the powder-filling member 4. At the same time, the powder-pressing member 5 is pressed downwards towards the capsule shell 1, so that the bottom surface of the powder-pressing member holder 14 is supported on the surface of the powder-filling member holder 13, and the bottom surface of the powder-filling member holder 13 is supported on the surface of the guiding peripheral edge 10. The bottom surface of the powder-pressing member 5 is then evenly flattened with the coffee powder inside the capsule shell 1. At this time, the air inside capsule shell 1 and powder guiding channel 7 is discharged outward through several ventilation slots 19.

Step 5: Remove the powder-pressing member 5 and the powder-filling member 4 from the mold seat 2.

Step 6: Using the guiding effect of the guiding peripheral edge 10, place the sealing film 30 on the outer ring 6, while ensuring that the adhesive ring with adhesive on the back of the sealing film 30 is aligned with the outer ring 6.

Step 7: Using the cooperation between the outer wall of the pressing mold 3 and the guiding peripheral edge 10 to place the pressing mold 3 on the mold seat 2, while ensuring the coaxial fit between the pressing mold 3, the sealing film 30, the capsule shell 1, and the mold seat 2. At this time, the up and down positions of the arc-shaped convex section 15 are respectively positioned on the pressing plane 23 and the mold seat positioning recessed ring 18.

Step 8: Press down the pressing mold 3 towards the capsule shell 1, so that the pressing plane 23 presses the sealing film 30 onto the outer ring 6 using the adhesive ring, in order to manufacture coffee capsules.

Step 9: Remove the pressing mold 3 and take out the manufactured coffee capsule from the positioning cavity 9.

In the above process, since the powder-pressing member 5 can be removed from the powder-filling member 4 at any time, the user can use the powder-pressing member 5 to press the coffee powder, and then remove the powder-pressing member 5 from the powder-filling member 4 and observe the coffee powder inside the capsule shell 1 through the powder guiding channel 7. If there is too little coffee powder, you can add more coffee powder to capsule shell 1 appropriately. If there is too much coffee powder, you can use a spoon to remove the coffee powder from capsule shell 1, and then use the powder-pressing member 5 to press the coffee powder down to improve the convenience of making coffee capsules.

In this embodiment, the bottom surface of mold seat 2 is flat, so the user can place the mold seat 2 smoothly on the desktop to achieve the manufacturing of coffee capsules. In addition, due to the guiding and blocking effect of powder guiding channel 7, the user can also grip the mold seat 2 by hand to complete the manufacturing of coffee capsules.

The above is a preferred embodiment of the present disclosure, which displays and describes the basic principles, main features, and advantages of the present disclosure. Those skilled in the art should be aware that the present disclosure is not limited by the aforementioned embodiments. The aforementioned embodiments and descriptions in the specification only illustrate the principles of the present disclosure. Without departing from the spirit and scope of the present disclosure, the present disclosure may undergo various changes and improvements, all of which fall within the scope of the claimed protection. The scope of protection of the present disclosure is defined by the accompanying claims and their equivalents.

What is claimed is:

1. A coffee capsule manufacturing tool, comprising a mold base for positioning and placing a capsule shell, and a pressing mold for pressing a sealing film onto the capsule shell, wherein the coffee capsule manufacturing tool further comprises a powder-filling member and a powder-pressing member;

an opening of the capsule shell extends outward with an outer ring;

a center of the powder-filling member is penetrated with a powder guiding channel for guiding and filling coffee powder and a bottom portion is provided with a powder-filling holder;

the powder-filling holder is supported on the outer ring;

an inside wall of the powder guiding channel extends towards the capsule shell and extends beyond the powder-filling holder, when the powder-filling holder is supported on the outer ring, the powder guiding channel extends into the capsule shell, the powder-pressing member extends into the powder guiding channel and uniformly compresses the coffee powder inside the capsule shell.

2. The coffee capsule manufacturing tool of claim 1, wherein a bottom surface of the powder-pressing member is a plane, and a bottom surface of the powder-pressing member aligns with or does not protrude beyond a bottom surface of the inside wall of the powder guiding channel when compressing the coffee powder.

3. The coffee capsule manufacturing tool of claim 1, wherein an interior of the mold base is provided with a positioning cavity matching a shape of the capsule shell;

an upper end surface of an outer wall of the mold base is provided with a guiding peripheral edge extending circumferentially and an inner wall of the guiding peripheral edge is inclined towards the capsule shell;

a side wall of the guiding peripheral edge is provided with a notch;

an outside wall of the mold base is provided with an inclined edge corresponding to the notch, the inclined edge located at a bottom of the notch.

4. The coffee capsule manufacturing tool of claim 3, wherein an upper end surface of an outer wall of the powder-filling member is provided with a powder-filling member holder extending circumferentially, a bottom surface of the powder-filling member holder is supported on a surface of the guiding peripheral edge;

an upper end surface of an outer wall of the powder-pressing member is provided with a powder-pressing member holder extending circumferentially and a bottom surface of the powder-pressing member holder is supported on a surface of the powder-filling member holder.

5. The coffee capsule manufacturing tool of claim 3, wherein an outer periphery of the outer ring is provided with an arc-shaped convex section;

an outer periphery of the powder-filling member holder is provided with a powder-filling member positioning recessed ring;

an opening of the mold base extends outward with a positioning platform;

an outer periphery of the positioning platform is provided with a positioning recessed ring;

the capsule shell is supported on the positioning platform by the outer ring;

when the powder-filling member is placed on the mold base, up and down positions of the arc-shaped convex section are respectively positioned and matched with the powder-filling member positioning recessed ring and the positioning recessed ring of the mold base in a concave convex manner; and a lower portion of the powder-filling member is provided with a powder-filling member guiding portion used to guide and place into the guiding peripheral edge, and the powder-filling member guiding portion is located in an outer periphery of the powder-filling member positioning recessed ring.

6. The coffee capsule manufacturing tool of claim 5, wherein the powder guiding channel is circular, and an upper portion of an inside wall of the powder guiding channel is provided with an inclined section facing the capsule shell;

the inclined section is composed of an inclined angle or multiple inclined angles connected end-to-end, a lower portion of the inclined section is provided with a vertical section, and a bottom end of the vertical section extends towards the capsule shell.

7. The coffee capsule manufacturing tool of claim 6, wherein the inclined section of the powder guiding channel is provided with several ventilation slots at circumferential intervals;

an opening of an upper end of the ventilation slot traverses the upper end surface of the powder-filling member;

a lower end of the ventilation slot extends to a middle portion or a lower portion of the inclined section of the powder guiding channel.

8. The coffee capsule manufacturing tool of claim 7, wherein an upper portion of an outside wall of the powder-pressing member is spaced apart and coordinated with the inclined section of the powder guiding channel;

a lower portion of an outside wall of the powder-pressing member is sequentially provided with a powder-pressing member inclined portion and a powder-pressing member vertical portion, the powder-pressing member inclined portion is inclined towards the capsule shell;

the powder-pressing member inclined portion is spaced apart and coordinated with a local position of the inclined section of the powder guiding channel;

the powder-pressing member inclined portion abuts against a remaining position of the inclined segment of the powder guiding channel; and the powder-pressing member vertical portion abuts against the vertical section of the powder guiding channel.

9. The coffee capsule manufacturing tool of claim 8, wherein the outside wall of the pressing mold is provided with a pressing mold inclined portion that matches the guiding peripheral edge;

a bottom surface of the pressing mold is provided with a circular recess in an opposite direction of the capsule shell;

an outer periphery of the circular recess is provided with a pressing plane;

an outer periphery of the pressing plane is provided with a pressing mold positioning recessed ring;

the powder-filling member and the powder-pressing member are removed from the mold base after the coffee powder is filled flat;

the mold base enters the guiding peripheral edge through the pressing mold inclined portion after the powder-filling member and the powder-pressing member are removed, and upon entering, the pressing plane presses the outer periphery of the sealing film onto the outer ring, the up and down positions of the arc-shaped convex section are respectively positioned and matched with the pressing mold positioning recessed ring and the positioning recessed ring of the mold base in a concave convex manner;

a lower portion of the pressing mold inclined portion is provided with a pressing mold guiding portion being used to guide and enter into the guiding peripheral edge;

the pressing mold guiding portion is located on an outer periphery of the pressing mold positioning recessed ring;

an upper end surface of an outside wall of the pressing mold is provided with a pressure mold holding portion extending circumferentially.

* * * * *